United States Patent [19]

Focke et al.

[11] 4,154,390

[45] May 15, 1979

[54] INNER PACK FOR MULTI-BLOCK CIGARETTE PACKS

[75] Inventors: Heinz Focke; Jurgen Focke, both of Verden, Fed. Rep. of Germany

[73] Assignee: Focke & Pfuhl, Verden, Fed. Rep. of Germany

[21] Appl. No.: 879,406

[22] Filed: Feb. 21, 1978

Related U.S. Application Data

[63] Continuation of Ser. No. 747,850, Dec. 6, 1976, abandoned.

[30] Foreign Application Priority Data

Dec. 5, 1975 [DE] Fed. Rep. of Germany ..... 2554731

[51] Int. Cl.[2] ..... B65D 85/10

[52] U.S. Cl. ..... 229/87 C; 229/27; 229/56; 206/256

[58] Field of Search ..... 206/256–258; 229/87 C, 51 C, 27, 29 R, 15, 29 B–29 E, 56

[56] References Cited

U.S. PATENT DOCUMENTS

| | | | |
|---|---|---|---|
| 1,256,965 | 2/1918 | Williams | 206/256 X |
| 1,702,325 | 2/1929 | Van Sickels | 229/87 C |
| 1,888,096 | 11/1932 | Shaw | 229/15 |
| 2,283,856 | 5/1942 | Hoenig | 229/87 C |
| 2,984,384 | 5/1961 | Chalmers et al. | 229/87 C |
| 3,533,550 | 10/1970 | Benzon-Petersen | 229/87 C |
| 3,536,246 | 10/1970 | Rosen | 206/256 X |

FOREIGN PATENT DOCUMENTS

| | | | |
|---|---|---|---|
| 374328 | 9/1959 | Switzerland | 229/15 |
| 423180 | 1/1935 | United Kingdom | 229/87 C |

*Primary Examiner*—William Price
*Assistant Examiner*—Joseph M. Moy
*Attorney, Agent, or Firm*—Sughrue, Rothwell, Mion, Zinn and Macpeak

[57] ABSTRACT

A unitary, tin foil blank is folded around two separate and adjacent cigarette blocks to form parting folds which extend through the tin foil blank between the cigarette blocks and physically separate the blocks from one another. Thus, the tin foil blank forms the inner wrapping for the cigarette blocks and consists of a common, one-part blank.

2 Claims, 6 Drawing Figures

INNER PACK FOR MULTI-BLOCK CIGARETTE PACKS

This is a continuation of application Ser. No. 747,850, filed Dec. 6, 1976, now abandoned.

FIELD OF THE INVENTION

The invention relates to a pack for cigarettes and similar rod-shaped articles which are enclosed by an inner wrapping and more particularly to a tin foil blank, in which several, preferably two groups of cigarettes (cigarette blocks), which are separated from one another, are accommodated in a common pack.

BACKGROUND OF THE INVENTION

In the case of large packs holding more than twenty-five cigarettes, it is usual to divide them up into two cigarette blocks separated from one another and to be smoked in succession. The cigarette blocks can be separated from one another by separate blank parts of paper, cardboard, etc.

It is an object of the invention so to construct packs of the kind specified with two or more cigarette blocks that they can be manufactured very simply with economic use of material.

SUMMARY OF THE INVENTION

The pack according to the invention is characterized in that the inner wrapping froming an inner pack for the cigarette block of a pack consists of a common, one-part blank, more particularly a tin foil blank. The tin foil blank is folded in a special manner around the two cigarette blocks in such a way that parting folds are formed which extend through the tin foil blank between the cigarette blocks and separate the blocks from one another.

However, the top, end-face folding of the tin foil blank is constructed in a special manner. On the one hand, this insures that the two cigarette blocks can be smoked independently of one another and therefore in succession to one another. However, on the other hand, a continuous outer or top cover flap insures that the top ends of all the cigarettes are adequately covered.

An embodiment of the invention will now be described in greater detail with reference to the drawings.

DESCRIPTION OF THE PREFERRED EMBODIMENT

The drawings show details of only two cigarette blocks 10, 11 and the common tin foil blank 12 which envelopes the blocks 10, 11. The resulting "inner pack" is subsequently received in further envelopes. More particularly, packs containing two cigarette blocks 10, 11 are constructed as a hinge-lid pack (not shown).

Figure 4:
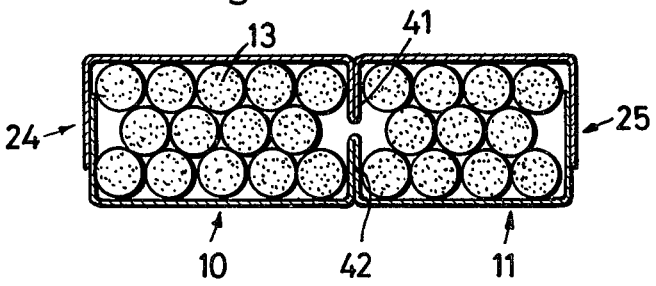
FIG. 4 is a horizontal section through a folded tin foil blank filled with cigarettes.

In packs having a total number of twenty-five cigarettes 13, the cigarette blocks 10, 11 each contain a different number of cigarettes. The division shown in FIG. 4 is particularly convenient, in which one cigarette block 10 consists of fourteen, and the other cigarette block 11 of eleven cigarettes 13. As a result, one cigarette 13 is disposed in the zone of each of the "corners" in each cigarette block 10, 11.

The two cigarette blocks 10, 11 are completely enveloped and separated from one another by the common tin foil blank 12 which is to this purpose divided up into individual areas and provided with incisions. The areas can be separated from one another by pre-marked folding lines (chain-dot lines). Areas therefore form front wall 14 and rear wall 15 for the zone of one cigarette block 10. Correspondingly narrower areas are bounded for the front wall 16 and rear wall 17 of cigarette pack 11. The front walls 14, 16 on the one hand and the rear walls 15, 17 on the other are separated from one another by areas for the formation of the bottom wall 18 (in the zone of the cigarette block 10) and 19 (in the zone of the cigarette block 11). The front walls 14, 16 and rear walls 15, 17 are adjoined laterally by side strips 20, 21; 22, 23. By registering, the latter form side walls 24, 25 of the finished blank, FIG. 4. In the longitudinal direction of the elongate tin foil blank 12, closure strips 26, 27 and side strips 20–23 adjoin the front walls 14, 16 and rear walls 15, 17.

The front wall 14, rear wall 15 and bottom wall 18 on the one hand, and the front wall 16, rear wall 17 and bottom wall 19 on the other are continuous, being divided from one another, as far as the zone of the closure strips 26, 27 by an inward folding strip 28. The inward folding strip 28 is divided by a central folding line 29 into two strips for forming partitions 30, 31.

In the zone of the length of the folding line between the bottom walls 18, 19 on the one hand and the front walls 14, 16 and rear walls 15, 17 on the other hand, the inward folding strip 28 has two parting cuts 32, 33 extending along the bottom edge. Top flaps 34, 35, each associated with a cigarette block 10, 11 are premarked on the blank 12. To this end, punching cuts 37, 36 are taken for each top flap 34, 35 in the transverse direction from the free edge as far as the central folding line 29. The punching cuts 36, 37 are interrupted by residual connections 38, so that cohesion with the remaining part of the blank 12 is insured via the residual connections 38. A punching cut 39 with residual connections 38 also extends in the zone of the central folding line 29 to divide the top flaps 34, 35 from one another.

The punching cut 39 is joined by a dividing cut 40 in the zone of the closure strip 26 which forms part of the top flaps 34, 35.

The resulting tin foil blank 12 is folded in U-shape around the two cigarette blocks 10, 11 in such a way that the bottom walls 18, 19 form the bottom of the web U-fold. During this phase, the cigarette blocks 10, 11 are separated from each other at a distance corresponding to the width of the inward folding strip 28, and therefore stand up on the associated bottom walls 18, 19. Then the side walls 24, 25 can be formed by the folding over and partial registering of the side strips 20–23.

Then, or previously, a separating or parting folding 41, 42, FIG. 4, is formed by the inward folding of the inward folding strip 28 from both sides between the cigarette blocks 10, 11, accompanied by the bringing of the blocks together. These parting folds 41, 42 which extend substantially as far as the (imaginary) longitudinal central plane of the pack, consist of the two partitions 30, 31 interconnected at central folding line 29.

Figure 1:
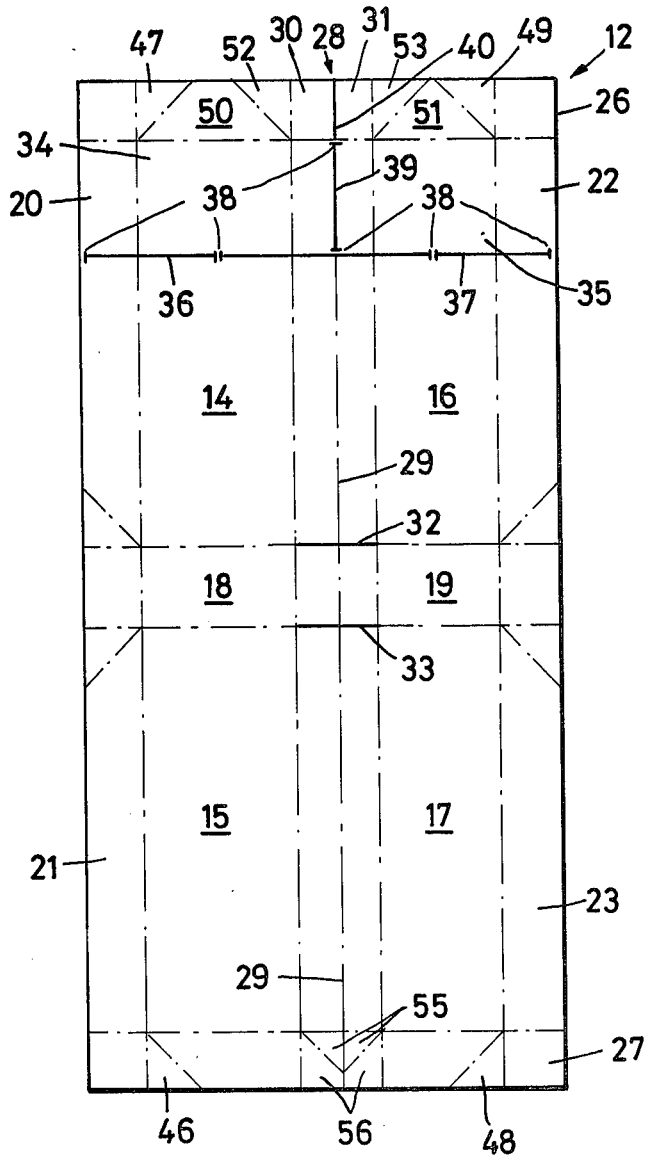
FIG. 1 is a plan view of a tin foil blank for an inner wrapping in spread-out condition of the present invention.
Figure 2:
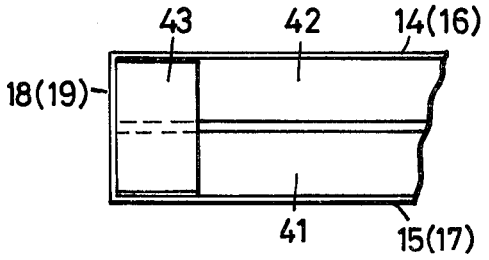
FIG. 2 is a vertical section through the lower part (bottom wall) of the tin foil blank during an intermediate folding position, prior to filling with cigarettes.
Figure 3:
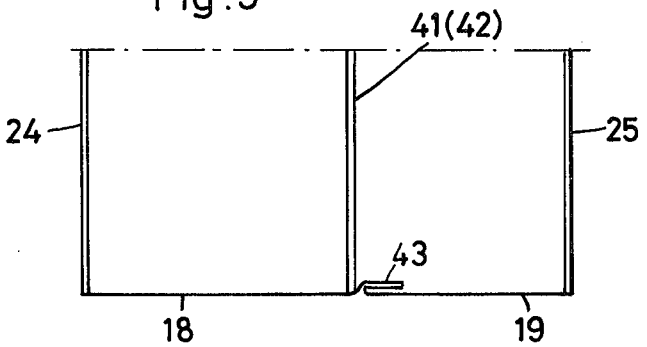
FIG. 3 is a vertical section through the detail in FIG. 1, turned through 90°, with the blank ready folded and also prior to filling with cigarettes.

In the bottom zone, a web 43, FIG. 2, is produced which is separated by the parting cuts 32, 33 from the parting foldings 41, 42 and extends from the bottom walls 18, 19. The webs 43 can remain in the upright position shown in FIG. 2, but alternatively, the web 43 can be folded around against either bottom wall 18 or 19. However, in that case, the partly pre-folded blank 12 can be filled only after the web 43 has been folded over in this way.

Figure 6:
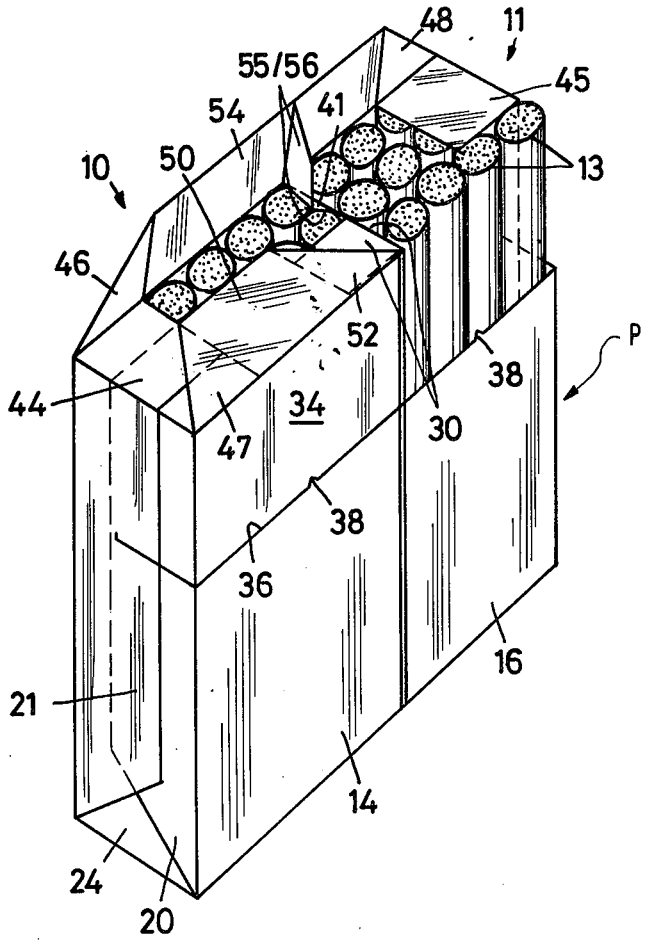
FIG. 6 is a perspective view of the partially ready folded tin foil blank with cigarettes.

As shown in FIG. 6, first projecting side flaps 44, 45 formed by the side walls 24, 25 are folded by adjoining triangular gussets 46, 47, 48, 49 against the content of a pack. Then inner longitudinal flaps 50, 51 (the latter is not shown in FIG. 6) are formed and folded against the contents of the pack. To this end, the zones of the partitions 30, 31, which are divided from one another by the dividing cut 40 with the adjoining triangular gussets 52, 53, are folded inwards and against the underside of the longitudinal flaps 50, 51, so that these as a whole have a trapezoidal shape. The longitudinal flaps 50, 51 accordingly each extend over only the zone of one cigarette block 10, 11.

Figure 5:
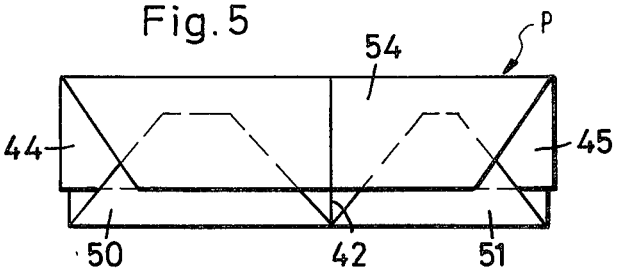
FIG. 5 is a plan view of the top, end-face closure folding of the tin foil blank.

An outer cover flap 54 takes the form of a cover extending over both cigarette blocks 10, 11. The cover flap 54 is formed from the closure strip 27. The central zone formed by the inwardly folding strip 28 is so folded by correspondingly disposed folding lines under the other zones of the cover flap 44 and laid around, that triangular flaps 55 and trapezoidal flaps 56 are folded over one another against the underside of the cover flap 54. The resulting inner pack P, FIGS. 5 and 6, is so disposed in the outer envelope (e.g., a hinge-lid pack) that the side with the top flaps 34, 35 and therefore the longitudinal flaps 50, 51 is disposed on the side opposite the hinge-lid. As a result, with the hinge-lid pack opened the longitudinal flaps 50, 51 can be seized (accompanied by the raising of the cover flap 54) and the particular top flap 34 or 35 can be pulled out, accompanied by the removal of the residual connections 38. FIG. 6 shows the top flap 35 of the cigarette block 11 completely removed in this way for access to the "inner pack P" interior.

While the invention has been particularly shown and described with reference to a preferred embodiment thereof, it will be understood by those skilled in the art that various changes in form and details may be made therein without departing from the spirit and scope of the invention.

What is claimed is:

1. An inner package for a composite package for cigarettes or similar rod-shaped articles in which the articles are separated into two groups, said inner package being formed by a blank, which is rectangular in the unfolded state, and being characterized by:

a center longitudinal fold line;

a dividing cut along a portion of said center longitudinal fold line at one end thereof;

second and third longitudinal fold lines, one on either side of and parallel to said center longitudinal fold line and spaced apart from said center longitudinal fold line;

third and fourth longitudinal fold lines along side portions of said blank;

first and second transverse fold lines in the center portion of said blank;

parting cuts along said transverse folds between said second and third longitudinal lines;

third and fourth transverse fold lines at opposite ends of said blank;

a transverse cut with interruptions between said first and third transverse fold lines; and a plurality of diagonal fold lines extending from said third and fourth transverse fold lines; wherein, in the folded state, the bottom wall of said inner package is formed between said first and second transverse fold lines, the side walls of said inner package are formed by the side portions of said blank outside said third and fourth longitudinal fold lines, parting folds folded inwardly in a V-shaped manner extend in a common plane from said second and third longitudinal fold lines towards the interior of said inner package with each extending to approximately the midline of the package so as to separate the inner package into first and second blocks, two separately removable top flaps having longitudinal trapezoidally-shaped end flaps defined by said diagonal fold lines extending from said third and fourth transverse fold lines formed between said transverse cut between said first and third transverse fold lines and said dividing cut along a portion of the center longitudinal fold line, and a folded web is formed in said bottom wall along said parting cuts along said first and second transverse fold lines.

2. The inner package of claim 1 further being characterized by diagonal fold lines extending from said first and second fold lines, wherein, in the folded state, four gussets are formed at the bottom of said side walls of said inner package.

* * * * *